US006108503A

United States Patent [19]

Motegi

[11] Patent Number: 6,108,503

[45] Date of Patent: Aug. 22, 2000

[54] COLOR PRINTER FOR MULTI-COLOR PRINTING BY SUPERIMPOSING A PLURALITY OF TONERS

[75] Inventor: Hidetaka Motegi, Tokyo, Japan

[73] Assignee: NEC Corporation, Tokyo, Japan

[21] Appl. No.: 09/343,719

[22] Filed: Jun. 30, 1999

[30] Foreign Application Priority Data

Jun. 30, 1998 [JP] Japan ..... 10-185031

[51] Int. Cl.[7] ..... G03G 15/01

[52] U.S. Cl. ..... 399/167; 347/115; 399/227; 399/299

[58] Field of Search ..... 399/159, 167, 399/227, 299; 347/115, 119

[56] References Cited

U.S. PATENT DOCUMENTS

| | | | |
|---|---|---|---|
| 3,772,010 | 11/1973 | Weiss | 430/48 |
| 3,790,375 | 2/1974 | Brock | 430/117 |
| 4,664,499 | 5/1987 | Alston | 399/159 |
| 4,939,548 | 7/1990 | Yamada et al. | 399/226 |
| 5,587,783 | 12/1996 | Nakamura et al. | 399/301 |

FOREIGN PATENT DOCUMENTS

| | | |
|---|---|---|
| 6-110291 | 4/1994 | Japan . |
| 9-80842 | 3/1997 | Japan . |
| 10-10825 | 1/1998 | Japan . |

*Primary Examiner*—Joan Pendegrass
*Attorney, Agent, or Firm*—Foley & Lardner

[57] ABSTRACT

A color printer which is small in size and capable of forming high-quality images though it is an electrophotographic type, including a cylindrical toner cartridge 8 for storing toners, photosensitive members 18, 20 and 22 disposed at a position such as to be in contact with the outer peripheral surface of the toner cartridge 8, a laser beam source 28 for applying a laser beam to the photosensitive members 18, 20 and 22, and a transfer roller 36 for transferring a toner image formed on an electrostatic latent image of the photosensitive members 18, 20 and 22 to a recording medium. The toner cartridge 8 has toner chambers 6 for storing toners 10, 12 and 14 of a plurality of colors, and is provided with a rotation driver 26 for rotating the toner cartridge to a position corresponding to the color of toner adhered to the photosensitive members 18, 20 and 22.

18 Claims, 2 Drawing Sheets

COLOR PRINTER FOR MULTI-COLOR PRINTING BY SUPERIMPOSING A PLURALITY OF TONERS

BACKGROUND OF THE INVENTION

1. Field of the Invention

The present invention relates to a color printer and, more particularly, to a color printer for performing multi-color printing by superimposing a plurality of toners.

2. Description of the Prior Art

In recent years, the performance of a printer has been enhanced in terms of not only printing speed but also resolution. In particular, for a relatively small-sized printer for personal and business use, a printer having a high speed and resolution, though being small in size, has been used. Such a small printer has been realized by an ink jet type. In Japanese Patent Laid-Open No. 6-110291 specification, an attempt has been made to provide a color imaging apparatus of high picture quality by a configuration such that the apparatus has a first photosensitive member and a second photosensitive member which rotate in contact with each other and a developing unit consisting of color developing devices C, M, Y and K of a plurality of colors, which are disposed close to the first photosensitive member; a toner image of each color formed individually on the first photosensitive member is repeatedly transferred to a recording paper wound around and conveyed by the second photosensitive member; and the color developing device C, M, Y and K of one color in the developing unit is selected in succession each time the first photosensitive member is rotated.

BRIEF SUMMARY OF THE INVENTION

Object of the Invention

However, the ink jet type has a problem in that when a color image is reproduced, the output is fine for ordinary paper, but the reproducibility of color is low for recycled paper generally used by users. Also, the electrophotographic type has a problem in that although it has high reproducibility of color and is low in running cost, the apparatus itself is large, so that this type is unsuitable for personal use.

Also, even in the aforementioned technology disclosed in Japanese Patent Laid-Open No. 6-110291 specification, since the first photosensitive member puts toners of a plurality of colors on one photosensitive member and the toners are transferred to a printing medium wound around the second photosensitive member, many colors adhere to the second photosensitive member, and transferred to the printing medium, so that there is the possibility of the image becoming different from the inherent color and of the reproducibility being deteriorated.

The present invention has been made to solve the above problems, and accordingly an object thereof is to provide a color printer which is small in size, though being of an electrophotographic type, and is capable of forming high-quality images.

Summary of the Invention

Thereupon, the color printer in accordance with the present invention comprises a cylindrical toner cartridge having toner chambers for storing toners of a plurality of colors, a plurality of photosensitive members of the same number as the number of a plurality of colors disposed at a position such that one of the photosensitive members could be in contact with the outer peripheral surface of the toner cartridge, a laser beam source for applying a laser beam to the photosensitive member, and a transfer roller for transferring a toner image formed on an electrostatic latent image of the photosensitive member to a recording medium. Also, the toner cartridge is provided with rotation driving means for rotating the toner cartridge to a position corresponding to the color of toner adhered to the photosensitive member for each color. Thereby, the aforementioned object of the present invention can be attained.

The laser beam source applies a laser beam to the photosensitive member. Then, an electrostatic latent image is formed on the photosensitive member. Each of the toner chambers of the cylindrical toner cartridge stores the toner of a different color. When the toner in the toner chamber is caused to adhere to the electrostatic latent image, a toner image is formed on the photosensitive member. At this time, the rotation driving means rotates the toner cartridge and an axis having a plurality of photosensitive members until the toner chamber reaches one of the photosensitive members corresponding to each color in accordance with the color of toner to be adhered. Thereby, the toners of a plurality of colors are caused to adhere to one of the photosensitive members corresponding to the plurality of colors by using one cylindrical toner cartridge.

DETAILED DESCRIPTION OF THE PREFERRED EMBODIMENTS

Figure 1:
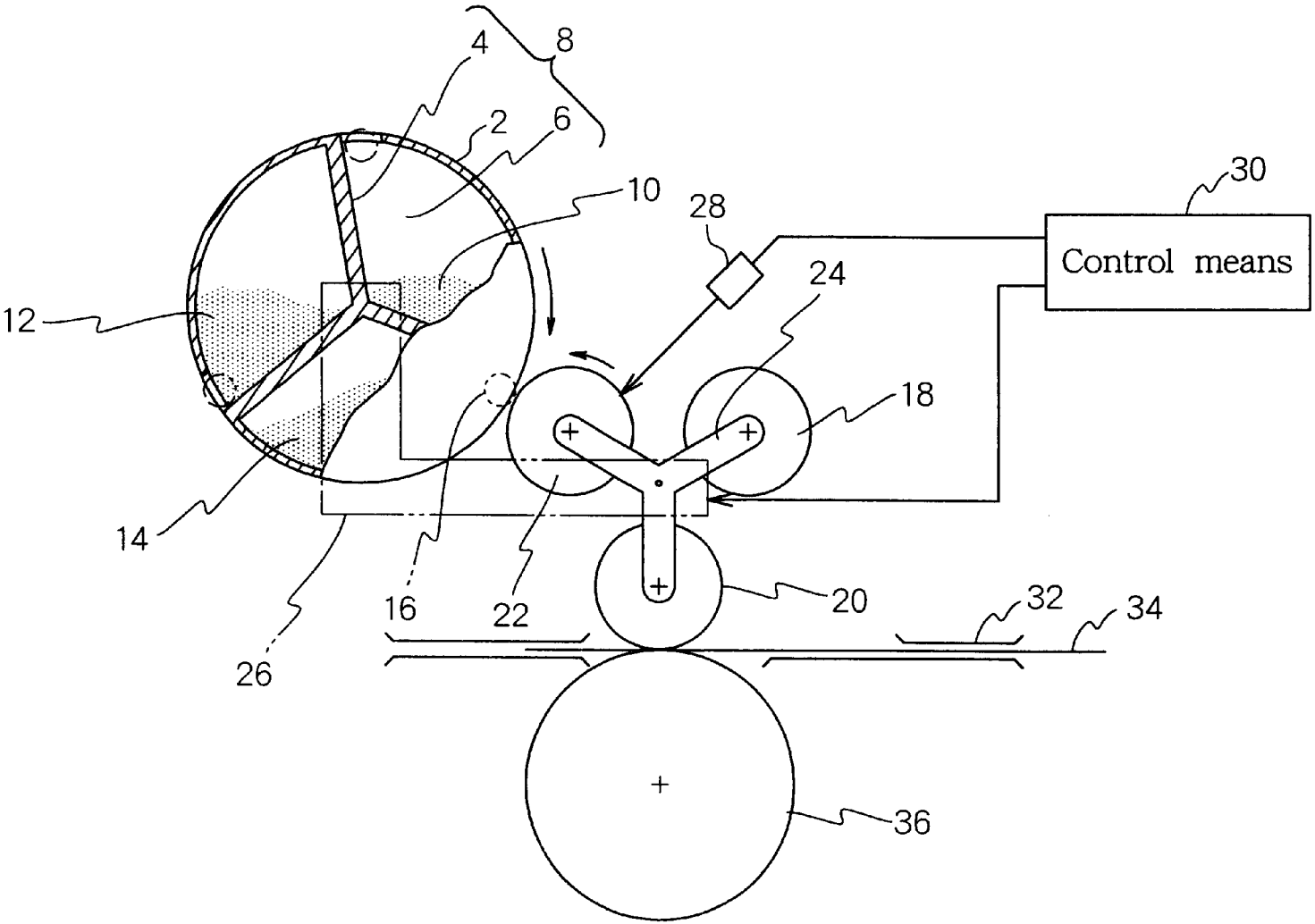
FIG. 1 is a sectional view showing a configuration of one embodiment of the present invention.

Embodiments of the present invention will be described below with reference to the accompanying drawings. FIG. 1 is a partially sectional view showing a configuration of a color printer in accordance with one embodiment of the present invention. In this embodiment, toner coloring matters, for example, cyan, magenta, and yellow, which are necessary for reproducing a color image, are put into one cartridge and integrated, by which the miniaturization of apparatus is achieved. Also, the annexed photosensitive member (photosensitive member etc.) could be made small in terms of width and volume, by which the apparatus can be made small. Further, in the present invention, proper configurations of the cartridge portion and the photosensitive member can make the apparatus even smaller in size.

As shown in FIG. 1, a color printer has a cylindrical toner cartridge 8 for storing toners, photosensitive members 18, 20 and 22 disposed at positions in contact with the outer peripheral surface of the toner cartridge 8, a laser beam source 28 for applying a laser beam to the photosensitive members 18, 20 and 22, and a transfer roller 36 for transferring a toner image formed on the electrostatic latent image of the photosensitive members 18, 20 and 22 to a recording medium. In addition, the toner cartridge 8 has toner chambers 6 for storing toners 10, 12 and 14 of a plurality of colors. Further, the toner cartridge 8 is provided with a rotation driving means, e.g., device, 26 for rotating the toner cartridge to a position corresponding to the color of toner to be adhered to one of the photosensitive members 18, 20 and 22. By using this means, the photosensitive member corresponding to a separate color receives toner corresponding to each color, so that the photosensitive members are not contaminated by many colors.

In the example shown in FIG. 1, the toner cartridge 8 has a cylindrical frame 2, partitioning plates 4 provided at a predetermined angle on the circumference of the frame 2, and toner chambers 6 each of which is provided between the partitioning plates 4 and the frame 2 and has a cross section of a fan shape as shown. Therefore, the cylindrical toner cartridge stores toners of a plurality of colors. When toners of three colors are used as shown in FIG. 1, three partitioning plates are provided, thereby forming three toner chambers 6. Each of the toner chambers 6 stores, for example, cyan 10, magenta 12, and yellow 14. By adding black to these colors, toners of four colors may be used.

Figure 2:
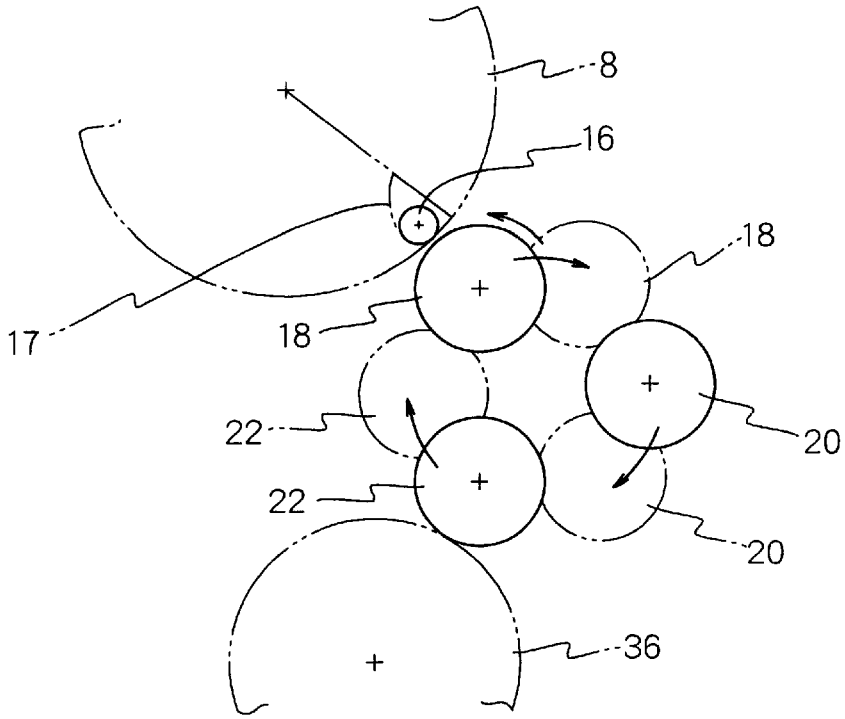
FIG. 2 is an explanatory view for illustrating the operation of a photosensitive roller shown in FIG. 1.

In the example shown in FIG. 1, the configuration is such that toner is adhered directly to the photosensitive member from each toner chamber. A photosensitive roller is provided for each toner color, and each toner is adhered to each photosensitive roller by rotating the photosensitive roller. Specifically, the photosensitive member consists of the same number of photosensitive rollers as the number of the toner chambers 6, which are the photosensitive rollers 18, 20 and 22. The plurality of the photosensitive rollers 18, 20 and 22 are provided at positions where they are revolved toward the outer periphery of the toner cartridge 8 following the rotation of the toner cartridge 8. As shown in FIG. 2, this photosensitive member integrally revolves in the clockwise direction, so that each of the photosensitive roller for each color could be positioned at the outer periphery of the toner cartridge in succession.

Also, in the example shown in FIG. 1, the plurality of photosensitive rollers 18, 20 and 22 are arranged at equal intervals on the circumference whose center is a predetermined center position. The center position is set so that the outer peripheral surfaces of the photosensitive rollers 18, 20 and 22 come into contact with the surface of the toner cartridge 8.

The rotation driving means, e.g., device, 26 has a gear mechanism and a motor for driving the gear mechanism, these elements are not shown in the figure. Also, the rotation driving means 26 has a photosensitive roller driving mechanism 24 which positions the photosensitive rollers 18, 20 and 22 toward the corresponding toner chamber 6 following the rotation of the toner cartridge 8. This photosensitive roller driving mechanism 24 integrally revolves the photosensitive rollers and positions each of the photosensitive rollers onto the outer peripheral surface of the toner cartridge.

Also, as shown in FIG. 1, the color printer has the laser beam source 28 for applying a laser beam to the photosensitive member (photosensitive roller) and control means 30 for controlling the laser beam source 28. This control means 30 controls the rotation of the toner cartridge and the rotation of the photosensitive members. Also, the color printer is provided with a conveying passage 32 for conveying a recording paper 34.

In the electrophotographic type printer, the electric charge changes at a portion which is irradiated by applying the laser beam 28 onto the photosensitive member 18. By applying an electric charge to the toner itself so that the toner adheres to the portion of the photosensitive member 18 where the electric charge changes, the toner is absorbed to the photosensitive member 18. When the absorbed toner comes onto the paper 34, a reverse electric charge is applied from the opposite side of the paper by the transfer roller 36, thereby causing the toner to adhere onto the paper 34. By fixing the toners onto the recording medium, a series of printing operations is completed. In case of color images, to reproduce the color images by mixing cyan 10, magenta 12, and yellow 14 in proper amounts, the toners of the coloring matters must be fixed on the paper.

The conventional system, which is provided with a cartridge and a photosensitive member for each of cyan 10, magenta 12, and yellow 14, requires a volume three times that of a monochromatic apparatus. In this embodiment, however, because only one cartridge 8 is provided and because the photosensitive rollers 18, 20 and 22 are disposed at support points of a triangle and revolve around the center, the size of the whole apparatus can be made small. The cartridge 8 is fixed, and the photosensitive roller 18 rotates, so that the toner of cyan 10 adheres to the photosensitive roller 18. Thereafter, the photosensitive roller 18 revolves, so that the photosensitive roller 18 comes onto the paper. At this time, the toner of cyan 10 is moved onto the paper 34 by the transfer roller 36 which is provided on the opposite side of the paper with respect to the photosensitive member side.

Next, the cartridge 8 is rotated clockwise so that the toner chamber storing magenta 12 comes into contact with the photosensitive roller 20 and the toner of magenta 12 adheres to only a portion irradiated with the laser beam 28. When the toner image of magenta 12 comes onto the paper 34, it is transferred by the transfer roller 26 and is fixed onto the paper. Further, using the toner chamber storing yellow 14 and the photosensitive roller 22, the toner is fixed onto the paper 34, by which an image can be formed.

FIG. 2 is a sectional view of the photosensitive members, viewed in the transverse direction. The photosensitive member 18 rotates counterclockwise so that the toner of cyan 10 adheres to the photosensitive member 18. The whole of the photosensitive members revolves clockwise, so that the photosensitive member 22 comes into contact with the cartridge, and causes the toner of yellow 14 to adhere while rotating counterclockwise. The whole of the photosensitive members revolves clockwise, and the toner of magenta 12 adheres to the photosensitive member 20 while the photosensitive member 20 rotates counterclockwise. When the toner of magenta comes onto the paper 34, the toner is moved onto the paper 34 by the transfer roller 36 and is fixed onto the paper.

Also, as shown in FIG. 2, when the toner is caused to adhere to the photosensitive roller 18 and other photosensitive rollers from the toner chamber 6, the toner may be caused to adhere via a toner supply roller 16 for supplying the toner. Thereby, the toner can be caused to adhere to the photosensitive roller uniformly and steadily. Also, since the toner chambers are provided by dividing the toner cartridge by using the partitioning plates, the toner can be stirred by the rotation of the toner cartridge. Further, when the toner supply roller 16 is provided at the end portion of each toner chamber, the well-stirred and high-quality toner can be supplied to the photosensitive roller steadily. When the toner supply roller 16 is provided at one end of the toner chamber as shown in FIG. 1, the toner can be supplied to the photosensitive roller while the toner is prevented from falling.

The following is a description of the operation of the color printer. First, the laser beam is applied onto the photosensitive member 18 corresponding to cyan 10. At this time, the cartridge 8 is fixed and the photosensitive roller 18 rotates so that the toner of cyan 10 adheres to the photosensitive roller 18. Thereafter, the photosensitive roller 18 revolves, so that the photosensitive roller 18 comes onto the paper 34. At this time, the toner of cyan 10 is moved onto the paper 34 by the transfer roller 36 which is provided on the opposite side of the paper with respect to the photosensitive members. Next, the cartridge 8 is rotated clockwise so that the toner of magenta 12 comes into contact with the photosensitive member 20 and the toner of magenta 12 adheres to only a portion irradiated with the laser beam 28. When the toner image of magenta 12 comes onto the paper 34, it is transferred by the transfer roller 36 and is fixed onto the paper. Further, using the toner chamber storing yellow 14 and the photosensitive roller 22, the toner is fixed onto the paper, by which an image can be formed. The photosensitive roller rotates and revolves as shown in FIG. 2 so that each toner is caused to adhere to the photosensitive roller and stick to the paper, and each color is fixed to the paper, thereby forming one image. In the example shown in FIG. 2, a toner guide 17 for guiding the toner to the toner roller is provided between the partitioning plate of toner chamber and the toner supply roller. This toner guide 17 performs a function of causing the toner to stay in the toner cartridge when the toner cartridge rotates.

Figure 3:
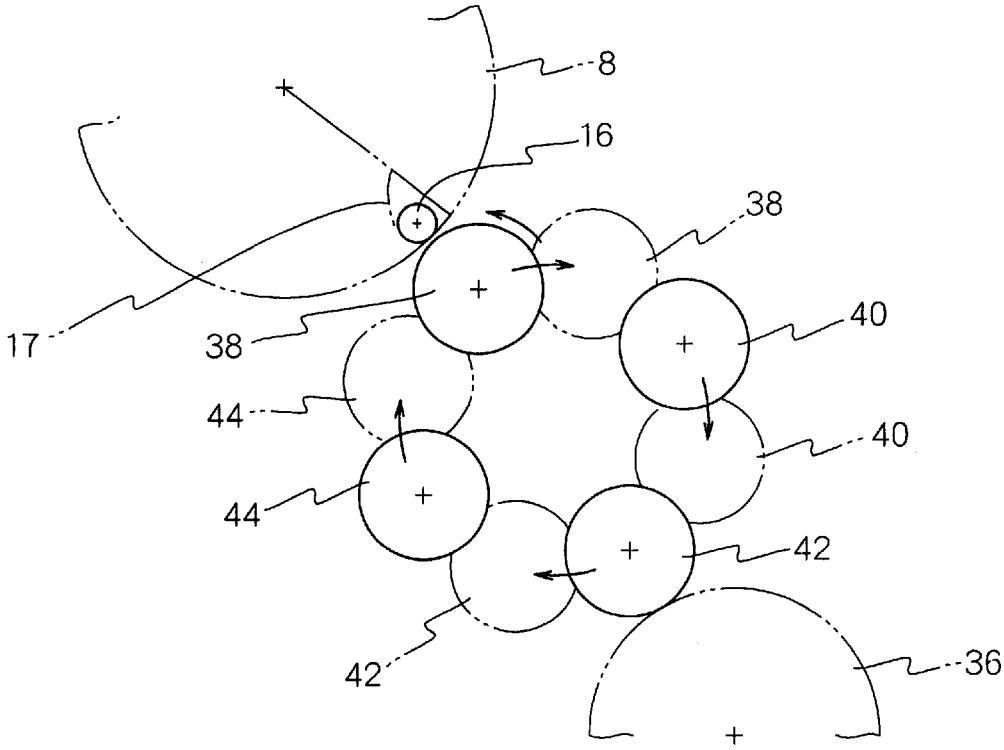
FIG. 3 is an explanatory view for illustrating the operation of a photosensitive roller in accordance with another embodiment of the present invention.

FIG. 3 shows a configuration of another embodiment of the present invention. In the example shown in FIG. 3, the cartridge 8 is divided into four areas, and has toners of three primary colors and black. Specifically, the cartridge shown in FIG. 3 is divided into four areas for storing magenta, yellow, cyan, and black toners on a cylinder respectively, and is configured so that the cartridge itself can be rotated. On the other hand, as shown in FIG. 3, four photosensitive rollers 38, 40, 42 and 44 are disposed corresponding to the areas in the vicinity of the cartridge. These rollers 38, 40, 42 and 44 each can be rotated around a predetermined center, and the whole of them can be revolved around the center of the square. Thereby, the same operation as that in the above-described embodiment can be performed. In the examples shown in FIGS. 2 and 3, when the arrangement relationship is as shown in the figures, the recording paper is conveyed in the slantwise direction.

Three cartridges have conventionally been needed to reproduce a color image. In the present invention, however, the cartridge is integrated, by which the apparatus can be made small. Further, by decreasing the number of cartridges, the cost of the apparatus itself can be lowered. Also, by configuring the photosensitive member annexed to the cartridge could be made small in terms of width and volume, thereby, the apparatus can be made even smaller.

The present invention, which has the above-described configuration and performs the above-described operation, achieves the following effects. Since the rotation driving means rotates the toner cartridge until the toner chamber reaches one of the photosensitive member corresponding to each color in accordance with the color of toner to be adhered, the toners of a plurality of colors can be caused to adhere to the plurality of photosensitive members corresponding to each color by using only one cylindrical toner cartridge. Therefore, electrophotographic color development can be performed in a small space, so that even in a small printer, for example, for personal use, the reproducibility of color can be enhanced as compared with the case of the ink jet type. Furthermore, since the photosensitive members are provided so as to correspond to the plurality of colors, the photosensitive members are not contaminated by other colors.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-185031 (Filed on Jun. 30$^{th}$, 1998) including specification, claims, drawings and summary are incorporated herein by reference in its entirety.

What is claimed is:

1. A color printer comprising:

a single cylindrical toner cartridge having a plurality of toner chambers, each toner chamber adapted for storing a toner comprising one of a plurality of colors;

a photosensitive member disposed at a position such as to be in contact with an outer peripheral surface of the toner cartridge;

a laser beam source for applying a laser beam to the photosensitive member;

a transfer roller for transferring a toner image formed on an electrostatic latent image of the photosensitive member to a recording medium; and a rotation driving mechanism for rotating the toner cartridge to a position corresponding to the color of toner adhered to the photosensitive member, wherein the photosensitive member further comprises a plurality of photosensitive rollers of the same number as the number of the toner chambers, and one of the plurality of photosensitive rollers is positioned on the outer peripheral surface of the toner cartridge following the rotation of the toner cartridge.

2. The color printer according to claim 1, wherein the plurality of photosensitive rollers are arranged at equal intervals on a circumference with a predetermined center position, and the center position is set so that the outer peripheral surfaces of one of the photosensitive rollers come into contact with the surface of the toner cartridge.

3. The color printer according to claim 1, wherein the rotation driving mechanism has a photosensitive roller driving mechanism for positioning one of the photosensitive rollers to one of the corresponding toner chamber following the rotation of the toner cartridge.

4. The color printer according to claim 3, wherein the photosensitive roller driving mechanism integrally revolves the plurality of photosensitive rollers.

5. The color printer according to claim 1, wherein the toner chamber has a toner supply roller for supplying the toner stored in the toner chamber to the photosensitive roller.

6. A color printer as recited in claim 1 wherein only one toner color is utilized on each of the plurality of photosensitive rollers.

7. A color printer as recited in claim 1, the cylindrical toner cartridge further comprising a plurality of toner cartridge partitioning plates for separating each of a plurality of toner colors stored in the toner chambers.

8. A color printer as recited in claim 7, wherein each of the plurality of toner cartridge partitioning plates are equally spaced within the toner cartridge.

9. A color printer as recited in claim 1, wherein the plurality of toner chambers comprises three chambers, and each chamber stores one of cyan, magenta, and yellow.

10. A color printer as recited in claim 1, wherein the plurality of toner chambers comprises four chambers, and each chamber stores one of cyan, magenta, yellow, and black.

11. A color printer comprising:

a single cylindrical toner cartridge having a plurality of toner chambers for storing toners comprising a plurality of colors;

a photosensitive device disposed at a position such as to be in contact with an outer peripheral surface of the toner cartridge;

a laser beam source for applying a laser beam to the photosensitive device;

a transfer roller for transferring a toner image formed on an electrostatic latent image of the photosensitive device to a recording medium; and a rotation driver device for rotating the toner cartridge to a position corresponding to the color of toner adhered to the photosensitive device, wherein the photosensitive device further comprises a plurality of photosensitive rollers of the same number as the number of the toner chambers, and one of the plurality of photosensitive rollers is positioned on the outer peripheral surface of the toner cartridge following the rotation of the toner cartridge.

12. A color printer as recited in claim 11 wherein only one toner color is utilized on each of the plurality of photosensitive rollers.

13. A color printer as recited in claim 11, the cylindrical toner cartridge further comprising a plurality of toner cartridge partitioning plates for separating each of the plurality of toner colors stored in the toner chambers.

14. A color printer as recited in claim 13, wherein each of the plurality of toner cartridge partitioning plates are equally spaced within the toner cartridge.

15. A color printer as recited in claim 11, wherein the plurality of toner chambers comprises three chambers, and each chamber stores one of cyan, magenta, and yellow.

16. A color printer as recited in claim 11, wherein the plurality of toner chambers comprises four chambers, and each chamber stores one of cyan, magenta, yellow, and black.

17. A method for color printing, comprising the steps of:

utilizing a single cylindrical toner cartridge with a plurality of toner chambers;

storing a toner comprising one of a plurality of colors in at least one of the toner chambers;

providing a contact between an outer peripheral surface of the toner cartridge and a photosensitive member;

applying a laser beam to the photosensitive member;

transferring a toner image formed on an electrostatic latent image of the photosensitive member to a recording medium; and a rotating the toner cartridge to a position corresponding to the color of toner adhered to the photosensitive member, wherein the photosensitive member further comprises a plurality of photosensitive rollers of the same number as the number of the toner chambers, and positioning one of the plurality of photosensitive rollers on the outer peripheral surface of the toner cartridge following a rotation of the toner cartridge.

18. A method for color printing, comprising the steps of:

providing a single cylindrical toner cartridge having a plurality of toner chambers for storing toners comprising a plurality of colors;

providing a contact with an outer peripheral surface of the toner cartridge and a photosensitive device;

applying a laser beam to the photosensitive device;

transferring a toner image formed on an electrostatic latent image of the photosensitive device to a recording medium;

rotating the toner cartridge to a position corresponding to the color of toner adhered to the photosensitive device, wherein the photosensitive device further comprises a plurality of photosensitive rollers of the same number as the number of the toner chambers, and positioning one of the plurality of photosensitive rollers on the outer peripheral surface of the toner cartridge following a rotation of the toner cartridge.

* * * * *